US008092189B2

(12) United States Patent
Ishii et al.

(10) Patent No.: US 8,092,189 B2
(45) Date of Patent: Jan. 10, 2012

(54) AXIAL FLOW PUMP

(75) Inventors: Takanori Ishii, Hitachi (JP); Akira Manabe, Kasumigaura (JP); Yasuhiro Inoue, Kasumigaura (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 957 days.

(21) Appl. No.: 11/649,166

(22) Filed: Jan. 4, 2007

(65) Prior Publication Data

US 2007/0264118 A1 Nov. 15, 2007

(30) Foreign Application Priority Data

Jan. 5, 2006 (JP) ..... 2006-000317

(51) Int. Cl.
*F04D 29/38* (2006.01)
*F01D 5/14* (2006.01)

(52) U.S. Cl. ..... 416/242; 416/243

(58) Field of Classification Search ..... 415/199.5; 416/198 R, 242, 243, DIG. 2
See application file for complete search history.

(56) References Cited

U.S. PATENT DOCUMENTS

| | | | | |
|---|---|---|---|---|
| 4,775,297 | A | 10/1988 | Bernauer | |
| 6,341,942 | B1 * | 1/2002 | Chou et al. | 416/228 |
| 6,508,630 | B2 * | 1/2003 | Liu et al. | 416/228 |
| 6,856,941 | B2 * | 2/2005 | Bradbury et al. | 702/182 |

FOREIGN PATENT DOCUMENTS

| | | | |
|---|---|---|---|
| EP | 0 237 921 | A2 | 9/1987 |
| GB | 268037 | A | 3/1927 |
| GB | 348032 | A | 5/1931 |
| GB | 581444 | A | 10/1946 |
| JP | 11-247788 | A | 9/1999 |
| WO | WO 02/055884 | A1 | 7/2002 |

OTHER PUBLICATIONS

European Search Report dated Mar. 12, 2007 (seven (7) pages).

* cited by examiner

*Primary Examiner* — Edward Look
*Assistant Examiner* — Sean J Younger
(74) *Attorney, Agent, or Firm* — Crowell & Moring LLP

(57) ABSTRACT

Radial cross sections of front sides in rotational direction of impellers attached to a pump shaft obliquely to a circumferential direction from an upstream side toward a downstream side have concave shapes protruding toward the upstream side, and radial cross sections of rear sides in rotational direction of the impellers have concave shapes protruding toward the downstream side.

11 Claims, 4 Drawing Sheets

AXIAL FLOW PUMP

BACKGROUND OF THE INVENTION

The present invention relates to an axial pump, particularly, an axial pump including a plurality of impellers attached to a pump shaft with those peripheries inclined from an upstream side to a downstream side.

An axial pump including a plurality of impellers attached to a pump shaft along a common circumference with those peripheries inclined from an upstream side to a downstream side, is disclosed by JP-A-11-247788 (refer to FIG. 4).

BRIEF SUMMARY OF THE INVENTION

A basic performance of generally known pumps including the axial pump as disclosed by JP-A-11-247788 is a capability of pumping liquid, that is, a sufficient pump head. The greater a difference in pressure between positive pressure surface and negative pressure side of the impeller, the greater the pump head is. A required pump head in specification is predetermined in accordance with a working condition of the pump, and the pump needs essentially to keep the predetermined pump head.

Since a fluid to be pumped is of liquid, a problem of cavitation exists. The cavitation is a phenomenon in which bubble is generated by boiling caused by pressure decrease in the fluid to not more than a saturated vapor pressure, the cavitation causes a decrease in transmission efficiency of energy applied from the impeller to the fluid, and causes a provability of that the impeller is damaged by an impact generated by disappearance of the bubble.

In the axial pump, a pressure is minimum in the vicinity of a front edge of the negative pressure surface at a front end of the impeller as a tip of the impeller so that the cavitation easily occurs. Therefore, the pump needs to make an area of the cavitation in the pump as small as possible.

Further, a tip side of the impeller faces to a shroud at its outer peripheral side with an extremely small clearance. Therefore, when the difference in pressure is great, the fluid leaks through the extremely small clearance from the positive pressure surface side to the negative pressure surface side to decrease the transmission efficiency of energy applied from the impeller to the fluid. Therefore, it is desired that the leakage at the tip side of the impeller is restrained.

An object of the present invention is to provide an axial flow pump in which a cavitation and leakage are restrained from occurring while keeping a pump head.

According to the invention for the above object, radial cross sections of front sides in rotational direction of impellers attached to a pump shaft obliquely to a circumferential direction from an upstream side toward a downstream side have concave shapes protruding toward the upstream side, and radial cross sections of rear sides in rotational direction of the impellers have concave shapes protruding toward the downstream side.

As described above, by making the radial cross sections of the front sides in rotational direction of the impellers have the concave shapes protruding toward the upstream side, a pressure at at least a side of impeller tip over a negative pressure surface in the vicinity of a front end in rotational direction of the impeller is increased to make a cavitation occurring region narrow. Further, a difference in pressure between a positive pressure surface and a negative pressure surface position at which the pressure is increased is decreased to restrain a leakage of the liquid from the positive pressure surface to the negative pressure surface on the impeller.

By making the radial cross sections of the rear sides in rotational direction of the impellers have the concave shapes protruding toward the downstream side, a camber of the circumferential cross section of the impeller protruding toward the upstream side at a radially intermediate position is increased to apply a main load to the impeller at the radially intermediate position. Therefore, without a decrease in pressure on the negative pressure surface at the side of impeller tip, in other words, with restraining the cavitation and leakage, the pump head can be kept unchanged.

Other objects, features and advantages of the invention will become apparent from the following description of the embodiments of the invention taken in conjunction with the accompanying drawings.

DETAILED DESCRIPTION OF THE INVENTION

Figure 1:
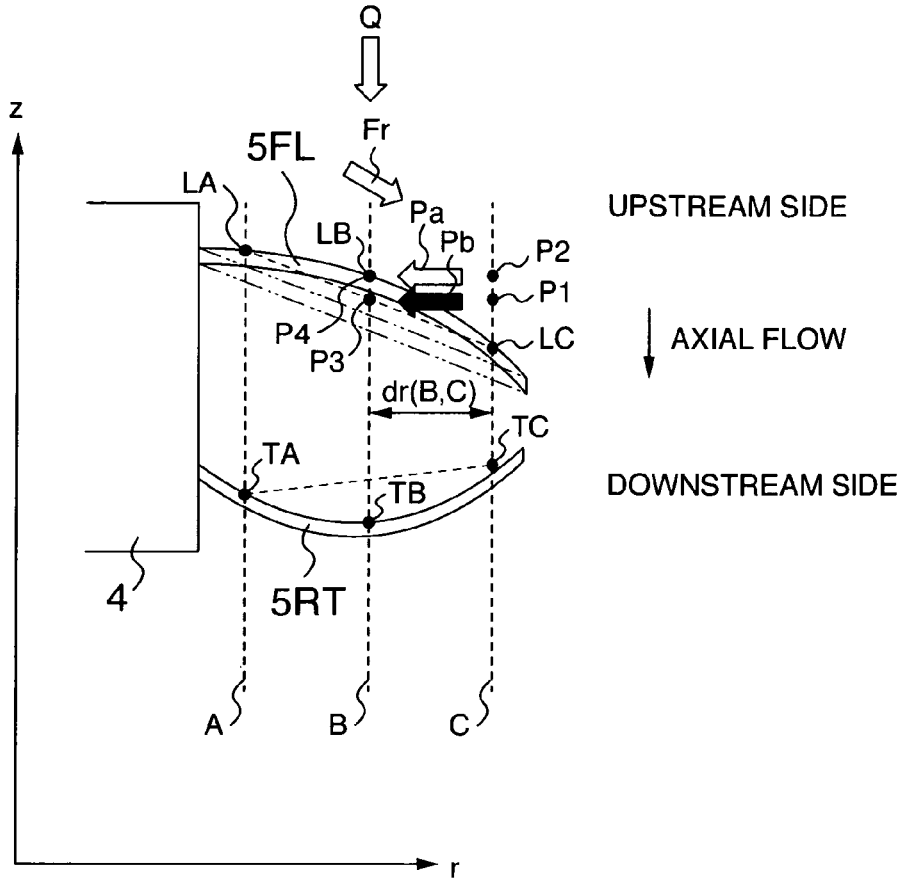
FIG. 1 is a schematic view showing cross sections of front and rear edges of an impeller of an axial flow pump of the invention.
Figure 2:
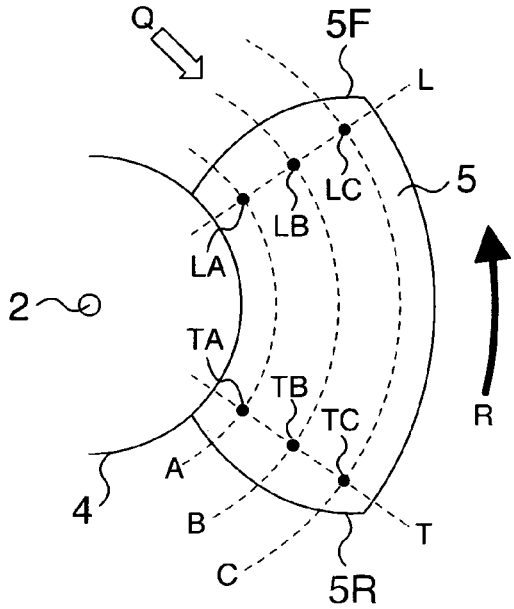
FIG. 2 is a front view of the impeller of the axial flow pump of the invention.
Figure 3:
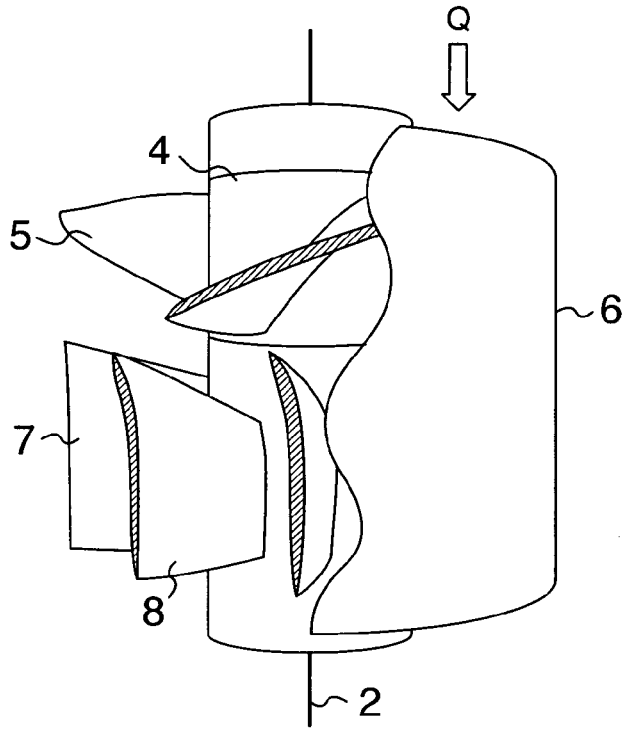
FIG. 3 is a partially cross sectional oblique projection view showing the axial flow pump of the invention.
Figure 4:
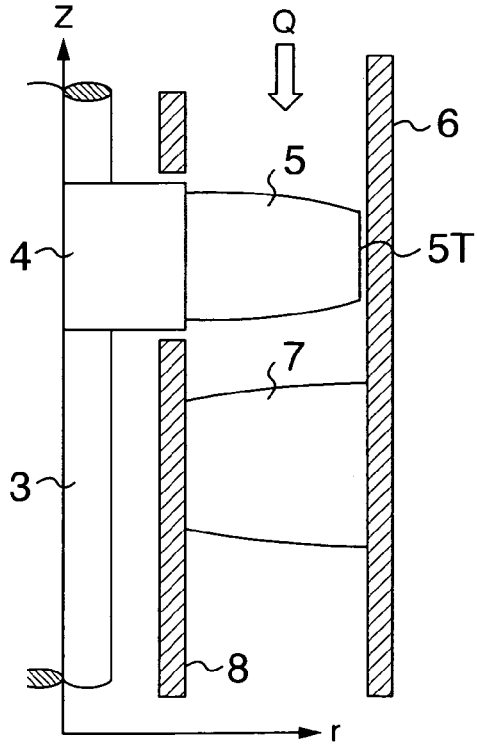
FIG. 4 is a longitudinally cross sectional view of FIG. 3.

Hereafter, an embodiment of an axial flow pump of the invention is described with making reference to FIGS. 1-4.

An axial flow pump 1 has impellers 5 arranged on an outer periphery of a hub 4 of a pump shaft 3 connected to a drive shaft 2, a shroud 6 covering impeller tips 5T as outer peripheries of the impellers 5 with an extremely small clearance therebetween, guide vanes 7 fixed to the shroud 6, and a casing 8 to which inner diameter sides of the guide vanes 7 are fixed and whose diameter is coaxial with and equal to the outer periphery of the hub 4.

The impellers 5 are attached to a common peripheral surface of the hub 4 of the pump shaft 3 and their peripheries are inclined from an upstream side toward a downstream side.

By driving the axial flow pump 1, the impellers 5 apply rotational energy to liquid Q flowing from an inlet side (upstream side) of the pump, and the rotational energy is converted by the guide vanes 7 at the downstream side to a pressure.

When longitudinal direction of the drive shaft 2 and the pump shaft 3 is z coordinate axis of cylindrical coordinate system, an angular position in rotational direction of the pump (circumferential direction of the drive shaft 2 and the pump shaft 3) is θ, a radial position from a center of the drive shaft is r, and the impellers 5 are rotated to suck in the liquid Q in a direction shown by an arrow mark R, the liquid Q flows from a front edge 5F of impeller arranged at a front side in a circumferential (rotational) direction toward a rear edge 5R of impeller arranged at a rear side in the circumferential (rotational) direction. With an imaginary plane L extending radially and in a direction parallel to the z axis to pass the front edge 5F of the impeller 5, an imaginary plane T extending radially and in the direction parallel to the z axis to pass the rear edge 5R of the impeller 5, an imaginary cylindrical face with a constant radial distance from the drive shaft 2, when the imaginary cylindrical face A is arranged close to the hub 4, the imaginary cylindrical face C is arranged close to the tip 5T of the impeller, and the imaginary cylindrical face B is arranged between the imaginary cylindrical faces A and B, the impeller 5 has a cross section 5FL along the imaginary plane L and a cross section 5RT along the imaginary plane T as shown in FIG. 1. The cross section 5FL at the impeller front tip 5F has a convex shape protruding toward the upstream side of the liquid Q, and the cross section 5RT at the side of the rear edge 5R has a convex shape protruding toward the downstream side of the liquid Q. Incidentally, in FIG. 2, points LA, LB, LC, TA, TB and TC are intersecting points between the imaginary planes L and T and the imaginary cylindrical faces A, B and C on a negative pressure surface (upstream side surface) of the impeller 5.

Figure 5A:
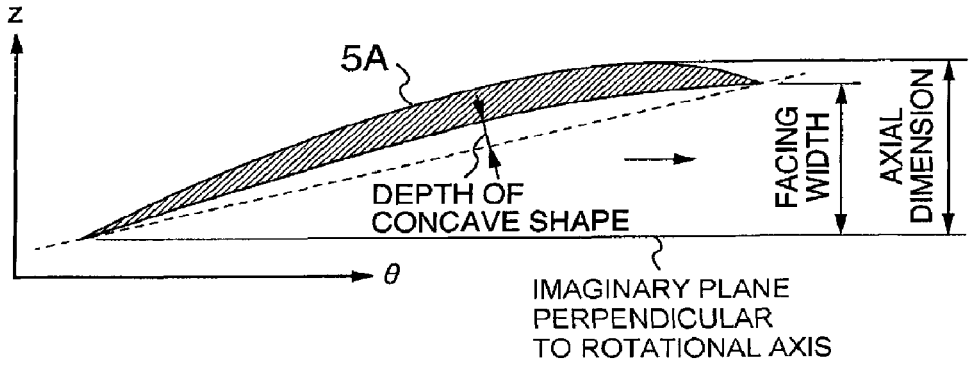
FIG. 5*a* is a spread out cross sectional view of the impeller of FIG. 1 taken along a cylindrical face A.
Figure 5B:
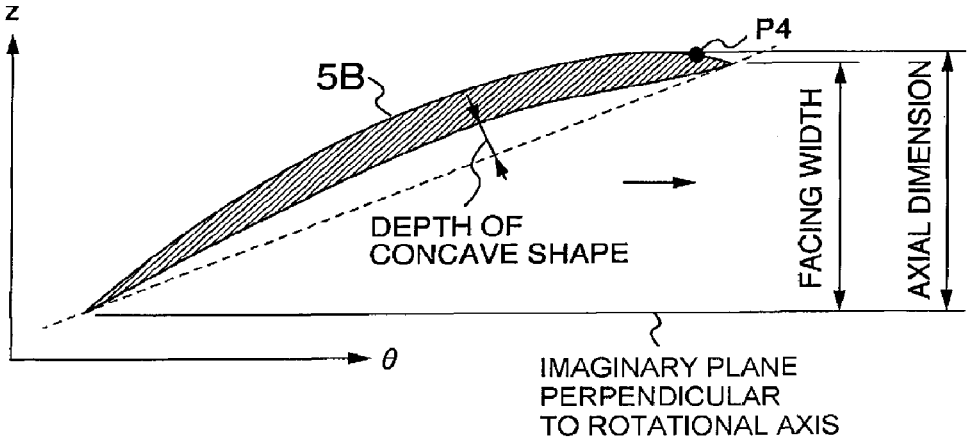
FIG. 5*b* is a spread out cross sectional view of the impeller of FIG. 1 taken along a cylindrical face B.
Figure 5C:
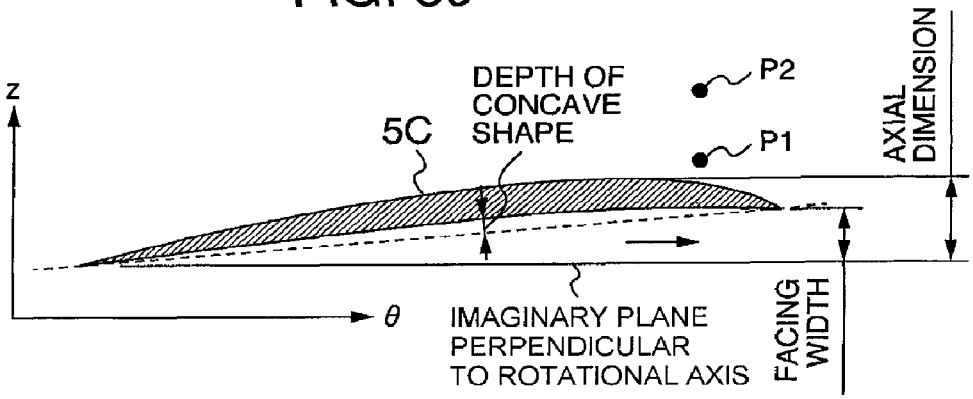
FIG. 5*c* is a spread out cross sectional view of the impeller of FIG. 1 taken along a cylindrical face C.
Figure 6:
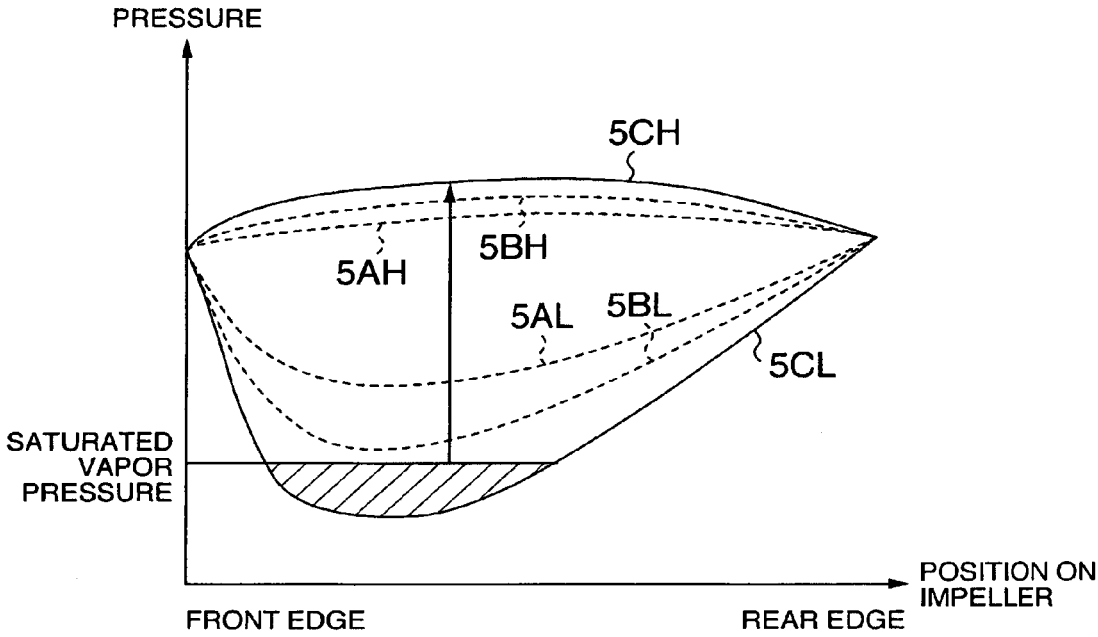
FIG. 6 is a diagram showing pressure distributions on respective cross sections shown in FIGS. 5*a*-5*c*.

The cross sections of the impeller 5 along the imaginary cylindrical faces A, B and C are cross sections 5A, 5B and 5C shown in FIGS. 5*a*-5*c* which illustrate the respective concave depth shape, the facing width between the front and rear edges of the impeller and axial dimension of the impeller at those faces. The pressure on the negative pressure surface of the upstream side of the liquid Q and the positive pressure surface of the downstream side of the liquid Q on the cross sections 5A, 5B and 5C are shown in FIG. 6. That is, the pressure on the cross section 5A has positive pressure 5AH and negative pressure 5AL, the pressure on the cross section 5B has positive pressure 5BH and negative pressure 5BL, and pressure on the cross section 5C has positive pressure 5CH and negative pressure 5CL.

A difference between the positive pressure 5CH and negative pressure 5CL of the cross section 5C along the imaginary cylindrical face C close to the tip 5T as the outer periphery of the impeller 5 is maximum.

An effect of the convex shape of the cross section 5FL protruding toward the upstream side of the liquid Q at the impeller front tip 5F is explained hereafter.

By making the lowest pressure of the negative pressure 5CL on the section 5C of the impeller 5 along the imaginary cylindrical face C higher, the saturated vapor is restrained from occurring to restrain the occurrence of the cavitation so that the leakage of the liquid Q through the extremely small clearance between the impeller tip 5T and the shroud 6 from the downstream side to the upstream side is restrained.

In FIG. 1, positions P1 and P2 in the imaginary plane L and imaginary cylindrical face C are taken into consideration. The position P1 is close to the negative pressure surface (upstream side surface) of the impeller 5, and the position P2 is distant from the negative pressure surface. As shown in FIG. 6, generally, the pressure decreases in accordance with a decrease in distance from the negative pressure surface, and is minimum on the negative pressure surface so that the pressure at the position P2 farther from the negative pressure surface is higher than that of the position P1. Therefore, pressure p (P1) at the position P1<pressure p (P2) at the position P2.

In FIG. 1, the positions P3 and P4 close to the negative pressure surface (upstream side surface of the impeller) on the imaginary cylindrical face B at an radially intermediate position r of the impeller 5 are considered. The position P3 is on a negative pressure surface of an impeller whose cross section 5FL at the front tip 5F does not protrude toward the upstream side of the liquid Q shown by two-dot chain line, and the position P4 is on the negative pressure surface of the impeller 5 whose cross section 5FL protrudes toward the upstream side. In a case where a shape of a front part of the impeller along the imaginary cylindrical face B is not differentiated significantly between the positions P3 and P4 similarly close to the impeller, the pressures at the positions P3 and P4 are substantially equal to each other. Therefore, a pressure p (P3) at the position P3 and a pressure p (P4) at the position P4 are nearly equal to each other.

A pressure gradient dp (Pb) along a radial direction from the position P1 toward the position P3 and a pressure gradient dp (Pa) along a radial direction from the position P2 toward the position P4 in the vicinity of the negative pressure surface of the impeller 5 are considered. When dr (B, C) is a distance between the imaginary cylindrical faces B and c in the radial direction r, the pressure gradients dp (Pa) and dp (Pb) become:

$$dp(Pa)=(p(P4)-p(P2))/dr(B,C), \text{ and}$$

$$dp(Pb)=(p(P3)-p(P1))/dr(B,C), \text{ while}$$

$$p(P1)<p(P2), \text{ and } p(P3)\approx p(P4),$$

therefore, dp (Pa)<dp (Pb), so that by the invention in which the cross section 5FL at the impeller front tip 5F protrudes toward the upstream side of the liquid Q, the pressure gradient dp (Pa) toward the pump shaft is decreased to restrain the flow from being urged radially outward from the pump shaft 3.

Generally, the flow of the liquid Q in the vicinity of the negative pressure surface of the impeller of the axial flow pump includes a secondary flow Fr directed away from the pump shaft or radially outward to urge the flow of the liquid Q toward the impeller tip 5T so that a load of the impeller is increased at the side of the impeller tip 5T. In the embodiment of the invention, by making the cross section 5FL at the impeller front tip 5F protrude toward the upstream side of the liquid Q, the pressure gradient dp (Pa) toward the pump shaft 3 is decreased to decrease the secondary flow Fr radially outward so that the load of the impeller is decreased at the side of the impeller tip 5T. Further, since the pressure gradient dp (Pa) toward the pump shaft 3 is decreased to increase the pressure on the negative pressure surface at the side of the impeller tip 5T so that the negative pressure is restrained from being included by a saturated vapor pressure range shown in FIG. 6, a region in which the cavitation occurs is decreased and the leakage of the flow from the positive pressure side (downstream side) to the negative pressure side (upstream side) at the side of the impeller tip 5T is decreased.

Figure 7:
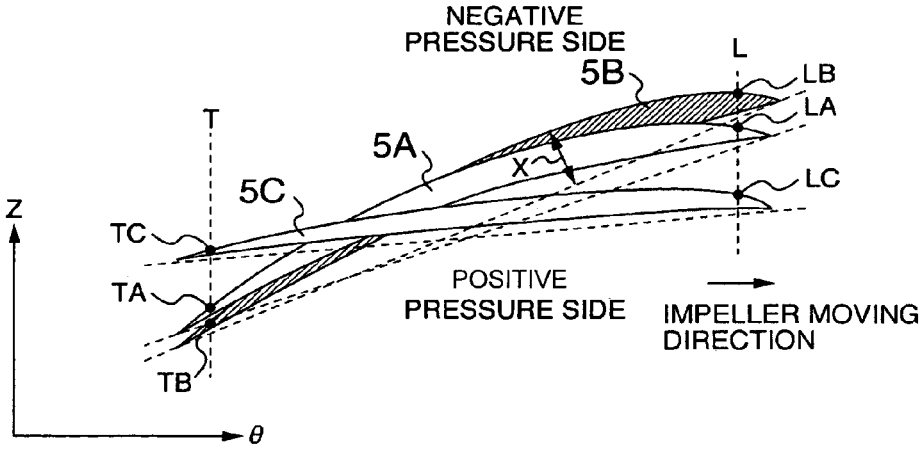
FIG. 7 is a cross sectional view showing the overlapped cross sections shown in FIGS. 5*a*-5*c*.

When the cross section 5FL at the side of the impeller front tip 5F is made protrude toward the upstream side of the liquid Q, the cavitation and the leakage are restrained, but the load at the side of the tip 5T of the impeller is decreased to decrease a pump head of the axial flow pump. Therefore, for restraining the cavitation and the leakage while keeping the pump head, in the embodiment of the invention, a cross section 5RT along an imaginary radial plane T at the side of the rear edge 5R of the impeller is made protrude toward the downstream side of the liquid Q. As shown in FIG. 7, a positional relationship among the points LA, LB and LC at the front edge 5F of the impeller forming the convex shape protruding toward the upstream side is z(LB)>(z(LA)+z(LC))/2, and a positional relationship among the points TA, TB and TC at the rear edge 5R of the impeller forming the convex (concave) shape protruding toward the downstream (upstream) side is z(TB)<(z(TA)+z(TC))/2.

By making the cross section 5RT along the imaginary radial plane T at the side of the rear edge 5R of the impeller protrude toward the downstream side, a chamber X (of the positive pressure surface depressed toward the upstream side (negative pressure side)) of the cross section 5B of the impeller 5 along the imaginary cylindrical face at the radially intermediate position of the impeller 5 is increased to increase the load for the impeller. This chamber X is greater than those (of the positive pressure surface depressed toward the upstream side) of the other positions (cross sections 5A and 5C) at the different radial positions of the impeller 5. By increasing the chamber X (of the positive pressure surface depressed toward the upstream side (negative pressure side)) of the cross section 5B, the load for the impeller on the cross section 5C along the imaginary cylindrical face C is not increased and the lowest pressure on the negative pressure surface at the side of the impeller tip 5T is not changed so that the effect of restraining the cavitation and the leakage is not deteriorated. Since the decrease of the pump head caused by making the cross section 5FT along the imaginary radial plane L at the front edge 5F of the impeller protrude toward the upstream (negative pressure) side is compensated by increase of the load for the impeller, the axial flow pump in which the cavitation and the leakage are restrained while keeping the pump head unchanged is obtainable.

Incidentally, the shape of the impeller 5 of the embodiment at the front edge 5F of the impeller is represented as a positional relationship in z coordinate among the points LA, LB and LC by $$z(LB)>(z(LA)+z(LC))/2, \text{ and}$$

the shape of the impeller 5 of the embodiment at the rear edge 5R of the impeller is represented as a positional relationship in z coordinate among the points TA, TB and TC by $$z(TB)<(z(TA)+z(TC))/2.$$

A degree of the sign of inequality is represented by $$dz(L)=z(LB)-(z(LA)+z(LC))/2, \text{ and}$$

$$dz(T)=(z(LA)+z(LC))/2-z(TB).$$

As a fluidal analysis on various shape of the axial flow pump, it is confirmed that when it is not less than 0.5% of a radius of the shroud 6, the distribution of the pressure is significantly improved.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An axial flow pump, comprising a pump shaft, a plurality of impellers attached to the pump shaft so that peripheries of the impellers are inclined from an upstream side thereof toward a downstream side thereof in a flowing direction of a liquid, and a shroud facing outer peripheries of the impellers with a clearance therebetween, wherein radial cross sections of front sides of the impellers, as viewed in a rotational direction, have convex shapes protruding toward the upstream side, and radial cross sections of rear sides of the impellers, as viewed in the rotational direction, have convex shapes protruding toward the downstream side, the radial cross sections being in a plane extending through a rotational axis of the pump shaft.

2. The axial flow pump according to claim 1, wherein circumferential cross sections of the impellers have convex shapes protruding toward the upstream side.

3. The axial flow pump according to claim 2, wherein a protrusion of the convex shape of the circumferential cross sections at a selected radially intermediate position of the impellers is greater than the protrusion of the convex shapes of the circumferential cross sections at other radially intermediate positions.

4. An axial flow pump, comprising a pump shaft, a plurality of impellers attached to the pump shaft and inclined to a first imaginary plane perpendicular to a rotational axis of the pump shaft so that the impellers cause a fluid to be drawn in an axial direction of the pump during pump shaft rotation, and having opposed surfaces as viewed in the axial direction, and an axially extending shroud surrounding outer peripheral tips of the impellers, wherein in a first cross section of each of the impellers along a second imaginary plane at a front portion of the impellers, as viewed in a rotational direction around the rotational axis and extending radially through the rotational axis, a first point on one of the surfaces is arranged upstream, as viewed in the fluid flow direction, with respect to an imaginary straight line passing second and third points on the one of the surfaces and between the second and third points as viewed in the radial direction; and wherein in a second cross section of each of the impellers at a rear portion of the impellers, as viewed in the rotational direction, which second cross section is in a third imaginary plane extending radially through the rotational axis, a first point on the one of the surfaces is arranged downstream, as viewed in the fluid flow direction, with respect to a second imaginary straight line passing second and third points on the one of the surfaces and between second and third points as viewed in the radial direction, and the first cross section is arranged at the upstream side in the fluid flow direction with respect to the second cross section.

5. The axial flow pump according to claim 4, wherein the one of the surfaces is arranged at the upstream side in the fluid flow direction with respect to the other one of the surfaces.

6. The axial flow pump according to claim 5, wherein a front end of the one of the surfaces in a moving direction of the impellers urges the fluid toward the upstream side and the other one of the surfaces urges the fluid toward the downstream side when the pump shaft rotates.

7. The axial flow pump according to claim 4, wherein a facing width of the other one of the surfaces in the axial direction in a cross section of each of the impellers along a first imaginary cylindrical face which is coaxial with the rotational axis and passing the first point is greater than a facing width of the other one of the surfaces in the axial direction in a cross section of each of the impellers along a second imaginary cylindrical face which is coaxial with the rotational axis and passing the second point and a facing width of the other one of the surfaces in the axial direction in a cross section of each of the impellers along a third imaginary cylindrical face which is coaxial with the rotational axis and passing the third point.

8. The axial flow pump according to claim 4, wherein a maximum depth of a convex shape of the other one of the surfaces from an imaginary supplemental straight line passing both terminating ends of the other one of the surfaces in a cross section of each of the impellers along a first imaginary cylindrical face which is coaxial with the rotational axis and passing the first point is greater than a maximum depth of a convex shape of the other one of the surfaces from an imaginary supplemental straight line other one of the surfaces in a cross section of each of the impellers along a second imaginary cylindrical face which is coaxial with the rotational axis and passing the second point and a maximum depth of a convex shape of the other one of the surfaces from an imaginary supplemental straight line passing both terminating ends of the other one of the surfaces in a cross section of each of the impellers along a third imaginary cylindrical face which is coaxial with the rotational axis and passing the third point.

9. The axial flow pump according to claim 4, wherein a dimension of each of the impellers in the axial direction in a cross section of each of the impellers along a first imaginary cylindrical face which is coaxial with the rotational axis and passing the first point is greater than a dimension of each of the impellers in the axial direction in a cross section of each of the impellers along a second imaginary cylindrical face which is coaxial with the rotational axis and passing the second point and a dimension of each of the impellers in the axial direction in a cross section of each of the impellers along a third imaginary cylindrical face which is coaxial with the rotational axis and passing the third point.

10. The axial flow pump according to claim 1, wherein each of the radial cross sections of the front and rear sides of the impellers is taken along a respective imaginary plane along which a rotational axis of the pump shaft extends and which extends radially outward from the rotational side.

11. An axial flow pump, comprising a pump shaft, a plurality of impellers attached to the pump shaft so that peripheries of the impellers are inclined from an upstream side thereof toward a downstream side thereof in a flowing direction of a liquid, and a shroud facing outer peripheries of the impellers with a clearance therebetween, wherein radial cross sections of upstream-side and downstream-side surfaces at a front portion of the impellers as viewed in an impeller rotational direction have convex shapes protruding toward the upstream side, and radial cross sections of upstream-side and downstream-side surfaces at a rear portion of the impellers as viewed in the impeller rotational direction have convex shapes protruding toward the downstream side.

* * * * *